US006783807B2

(12) United States Patent
Hüffer et al.

(10) Patent No.: US 6,783,807 B2
(45) Date of Patent: Aug. 31, 2004

(54) METHOD FOR COATING APPARATUSES AND PARTS OF APPARATUSES FOR THE CONSTRUCTION OF CHEMICAL INSTALLATIONS

(75) Inventors: Stephan Hüffer, Ludwigshafen (DE); Thilo Krebs, Mannheim (DE); Klaus-Dieter Hungenberg, Birkenau (DE); Ingolf Kühn, Schmerbach (DE); Ekkehard Jahns, Weinheim (DE); Christian Lach, Bad Dürkheim (DE); Harald Keller, Ludwigshafen (DE); Andreas Pfau, Ludwigshafen (DE); Thomas Frechen, Heidelberg (DE); Bernd Diebold, Fussgönheim (DE); Peter Dillmann, Insheim (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 15 days.

(21) Appl. No.: 10/239,826

(22) PCT Filed: Mar. 27, 2001

(86) PCT No.: PCT/EP01/03464

§ 371 (c)(1),
(2), (4) Date: Sep. 26, 2002

(87) PCT Pub. No.: WO01/73162

PCT Pub. Date: Oct. 4, 2001

(65) Prior Publication Data

US 2003/0054114 A1 Mar. 20, 2003

(30) Foreign Application Priority Data

Mar. 31, 2000 (DE) ..... 100 16 215

(51) Int. Cl.[7] ..... B05D 3/12; B05D 1/18

(52) U.S. Cl. ..... 427/437; 427/438; 427/443.1; 427/307; 427/309; 428/565; 428/680

(58) Field of Search ..... 427/437, 438, 427/443.1, 307, 309; 428/565, 680

(56) References Cited

U.S. PATENT DOCUMENTS

| | | | | |
|---|---|---|---|---|
| 3,614,363 A | | 10/1971 | Fujita | 200/168 |
| 3,753,667 A | | 8/1973 | Metzger et al. | 29/195 |
| 4,666,786 A | * | 5/1987 | Yano et al. | 428/544 |
| 5,175,988 A | | 1/1993 | Kibe | 57/119 |
| 5,514,422 A | | 5/1996 | McCune | 427/449 |

FOREIGN PATENT DOCUMENTS

| | | |
|---|---|---|
| EP | 737759 | 10/1996 |

OTHER PUBLICATIONS

Hubbell, "A New Generation of Electroless Coatings", Plating and Surface Finishing, vol. 65, No. 6, 1978, pp. 58–62.*
Zhang et al., "Characterization of electroless Ni–P–PTFE composite deposits", Journal of Materials Science Letters, vol. 17, 1998, pp. 119–122.*
Hubbell, *Plating and Surface Finishing*, vol. 65, No. 6, 1978, pp. 58–62.
Database WPI, Section Ch, Week 200130, Derwent Publications, Ltd., AN2001–284978, XP002188597 (JP 2000 327948A, Nov. 28, 2000).
Derwent Abstract 96/129205/13 (WO 9604123–A1), Jul. 29, 1994.
Watkinson et al., *Exp. Thermal and Fluid Science*, 1997, 14:1361–1374.
*Chem. Abst.*, No. 111: 82771z (JP 63:286561, Nov. 24, 1988).
*Chem. Abst.*, vol. 98, 1983, No. 98:165666h (CH 633586, Dec. 15, 1982).
Wolfgang Riedel, *Galvanotechnik* 81; 1990, No. 3, pp. 842–844.
S.S. Tulsi, *Trans. of the Inst. of Metal Finishing*, vol. 61, 1983, pp. 147–149.
Zhang et al., *J. of Mat. Sci. Letters*, vol. 17, 1998, pp. 119–122.
F.N. Hubbell, *Plating and Surface Finishing*, 1978, pp. 58–62.
Lin et al., *Plating and Surface Finishing*, 1989, pp. 48–50.
Derwent Abstract 96–129205/13, Jul. 29, 1994 (=WO 96/04123).
*Chem. Abst.*, vol. 131, No. 11, 1999, AN 131:145375j (=EP–A 0933388).
Derwent Abstract 2000–477016/42, Dec. 30, 1998 (=WO 00/40774 and WO 00/40775).

* cited by examiner

*Primary Examiner*—Michael Barr
(74) *Attorney, Agent, or Firm*—Keil & Weinkauf

(57) ABSTRACT

The surfaces of apparatuses and apparatus parts for chemical plant construction, including, for example, apparatus, container and reactor walls, discharge apparatuses, fittings, pumps, filters, compressors, centrifuges, columns, heat exchangers, dryers, comminuting machines, internals, packings and mixing elements, are coated by a process wherein protuberances having a mean height of from 100 nm to 50 μm with a mean spacing of from 100 nm to 100 μm are produced on the surface to be coated and the coating is applied thereon by currentless deposition of a metal layer or of a metal-polymer dispersion layer with the aid of a plating bath which contains a metal electrolyte, a reducing agent and optionally a polymer or polymer blend to be deposited, in dispersed form.

16 Claims, No Drawings

METHOD FOR COATING APPARATUSES AND PARTS OF APPARATUSES FOR THE CONSTRUCTION OF CHEMICAL INSTALLATIONS

The present invention relates to a process for coating apparatuses and apparatus parts for chemical plant construction, including, for example, apparatus, container and reactor walls, discharge apparatuses, fittings, pumps, filters, compressors, centrifuges, columns, heat exchangers, dryers, comminuting machines, internals, packings and mixing elements.

Deposits in apparatuses and apparatus parts for chemical plant construction constitute a serious problem in the chemical industry. Particularly affected are apparatus, container and reactor walls, discharge apparatuses, fittings, pumps, filters, compressors, centrifuges, columns, dryers, comminuting machines, internals, packings and mixing elements. These deposits are also referred to as fouling.

The deposits may be harmful or obstructive to the process in various ways and lead to the necessity of repeatedly shutting down and cleaning corresponding reactors or processing machines.

Measuring means encrusted with deposits can lead to incorrect and misleading results, through which operating errors can occur.

A further problem arising from the formation of deposits is that, in particular in the case of deposits in polymerization reactors, the molecular parameters such as molecular weight or degree of crosslinking deviate substantially from the product specifications. If deposits become detached during operation, they may contaminate the product (for example, specks in finishes, inclusions in suspension beads). In the case of reactor walls, packings or mixing elements, undesired deposits can furthermore lead to an undesired change in the resistance type profile of the apparatus or impair the efficiency of the internals or mixing elements as such. Coarse fragments breaking off from deposits can lead to blockage of discharge and working-up apparatuses, while small fragments can impair the product produced.

The deposits whose formation is to be prevented are deposits which may be caused, for example, by reactions with and on surfaces. Further reasons are adhesion to surfaces, which may be caused by van der Waals forces, polarization effects or electrostatic double layers. Other important effects are stagnation on the surface and possibly reactions in said stagnant layers. Finally, other examples are precipitates from solutions, evaporation residues, cracking on locally hot surfaces and microbiological activities.

The causes are dependent on the respective combinations of substances and may be effective alone or in combination. While the processes which give rise to the undesired deposit have been thoroughily investigated (for example, A. P. Watkinson und D. I. Wilson, Experimental Thermal Fluid Sci. 1997, 14, 361, and literature cited therein), there are only a few standard concepts for preventing the deposits described above. The methods known to date have technical disadvantages.

Mechanical solutions have the disadvantage that they can give rise to considerably higher costs. Additional reactor internals may furthermore substantially change the flow profile of fluids in the reactors and hence necessitate an expensive new development of the process. Chemical additives can lead to undesired contamination of the product and in some cases pollute the environment.

For these reasons, attempts are increasingly being made to find possibilities for directly reducing the tendency to fouling by modification of the chemical reactors, reactor parts and processing machines for chemical products.

WO 00/40774 and WO 00/40775, published on Jul. 13, 2000, describe a process for the coating of surfaces, especially surfaces of reactors for the high-pressure polymerization of 1-olefins, by currentless deposition of an NiP/PTFE layer or a CuP/PTFE layer, by means of which the relevant metal surfaces may be modified to impart antiadhesion properties. However, a careful investigation shows that, when such a layer is used, the walls in chemical apparatuses still have a certain wettability by fluids. This wettability means that the antiadhesion properties can be further improved.

WO 96/04123 discloses self-cleaning surfaces which can be coated with polytetrafluoroethylene and have particularly hydrophobic properties. The structuring is carried out by etching or embossing the surface, by physical methods, such as sandblasting, or by ion etching with, for example, oxygen. The surface is then coated with Teflon. However, the mechanical stability of layers rendered hydrophobic in this manner is much too low for use in chemical apparatus construction, in particular for polymerization reactors in which strong sheer forces act.

Other known structured surfaces having hydrophobic properties (EP-A 0 933 388) are those which are produced, for example, by etching the relevant surface, thus producing protuberances or grooves on the surface and then coating the latter with a layer of a hydrophobic polymer, for example, polyvinylidene fluoride. These layers may furthermore contain fluorinated waxes, for example, Hostaflone®. Although the surfaces modified in this manner are hydrophobic, they are not very mechanically resistant. JP 63-293169 describes a process for protecting heat exchangers from corrosion, in particular by HCl-containing gases, which comprises four successive steps:

1. electrolytic deposition of an Ni layer from an $NiCl_2$-containing concentrated aqueous HCl solution; the electrolytic deposition is responsible for the good adhesion of the subsequent layers;
2. electrolytic deposition of a further Ni layer by the use of a Weisberg bath, consisting of $NiSO_4$, $NiCl_2$, boric acid, $COS0_4$, nickel formate and formalin solution and water;
3. currentless deposition of an Ni—P layer comprising 90–95% of Ni and 5–10% of phosphorus;
4. currentless deposition of an Ni—B layer comprising 90–99% of Ni and 1–10% of boron.

This multistage process is technically very complicated. It uses HCl, which gives rise to corrosion problems in workshops in which such coating is carried out and furthermore gives heat exchangers on which deposits and caked material can still form.

CH 633586 describes a process for metallization, for example with Ni—P alloys. The metallized layers are used for providing protection against corrosion and for improving the hardness (page 2, column 2, lines 27 to 29). However, if apparatuses or apparatus parts for chemical plant construction are coated with an Ni—P alloy, a sufficient reduction in the tendency to form deposits and to cake is not observed.

Galvanotechnik 81(3) (1990), 842 et seq. likewise describes a process for coating apparatuses, for example extruder screws, with Ni—P (chemical nickel). Hard and very hard-wearing coatings are obtained (cf. especially page 844, 2nd paragraph). Numerous metals can be applied as firmly adhering coating (page 843, column 2, 2nd paragraph), which is to be understood as meaning that the coating does not flake off. The problem of the formation of deposits is not solved.

Transactions of the Institute of Metal Finishings 61 (1983), 147–9 and J. Mat. Sci. Lett. 17 (1998), 119 (Y. Z. Zhang et al.) describe Ni—P-PTFE coating for preventing caking. For numerous applications in plant construction, however, the coatings described are in most cases not sufficiently stable since they flake off or exhibit cracks after a short time.

EP-A 0 737 759 describes a coating which is intended for protecting against corrosion and comprises two coats: an Ni—P coat and an Ni—P-PTFE coat. Both drawings 1A and 1B and the photographs 2 to 4 show coarse structures and cracks and holes in the coating. Holes can be closed by adding extremely fine PTFE particles, fluorinated graphite, ceramic or the like during the 2nd coating step (column 9, lines 1–9). EP-A 0 737 759 does not state how fine these additional particles have to be and how they are produced. However, the addition of a further reagent is inconvenient, and moreover there is no indication as to how cracks can be filled. However, algal growth is possible in the cracks of the coating, for example, and may adversely affect the mode of action of the coating.

U.S. Pat. No. 3,617,363 and U.S. Pat. No. 3,753,667 describe the addition of solid particles to chemical nickel baths and observe that the solid particles are deposited with Ni—P alloys. This substantially improves the abrasion resistance of the Ni—P layers. In Plat. Surf. Finish. 65 (1978), 59, F. N. Hubbell investigates the addition of SiC particles during the deposition of an Ni—P layer. By adding SiC particles, the abrasion resistance of the layer is increased. However, a disadvantage of the addition of particles to chemical nickel baths is that it is frequently observed that the particles lead to catalytic decomposition of the dip bath solutions, as mentioned, for example, by Hubbell on page 58, right column, 2nd paragraph under the table. Stabilizers in amounts over and above normal requirements and further additives which are not specified therefore have to be added to the dip baths. However, this makes the deposition process tedious and uneconomical.

In *Plat. Surf. Finish* 76 (1989), 48 et seq., K.-L. Lin and P.-J. Lai add $Al_2O_3$ particles to chemical nickel baths in order to increase the hardness of the coatings, but observe the formation of nickel phosphite seeds and hence an undesired weakening of the coating. They therefore recommend heating of coated plant parts as being advantageous with respect to the deposition of solid added particles. However, the heated coats do not prevent the formation of deposits.

It is an object of the present invention to provide a process for the surface modification of apparatuses and apparatus parts for chemical plant construction, which on the one hand greatly reduces the tendency of the surfaces to accumulate solids with formation of deposits, and which, on the other hand, gives very stable coatings, in particular to mechanical loads, and which does not have the disadvantages observed in the prior art.

It is a further object of the present invention to provide protected surfaces of apparatuses and apparatus parts for chemical plant construction, and finally to use such apparatuses and apparatus parts for chemical plant construction.

We have found that this object is achieved by a process for coating apparatuses and apparatus parts for chemical plant construction, wherein protuberances having a mean height of from 100 nm to 50 $\mu$m with a mean spacing of from 100 nm to 100 $\mu$m are produced on the surface to be coated and the coating is applied thereon by currentless deposition of a metal layer or of a metal-polymer dispersion layer with the aid of a plating bath which contains a metal electrolyte, a reducing agent and optionally a polymer or polymer blend to be deposited, in dispersed form.

The present invention relates especially to a process for the coating of surfaces, wherein the surface is structured in situ by adding to the plating bath inorganic particles selected from oxides or mixed oxides of B, Si, Al, Ti, Zr, Cr, silicates of Al, Ca or Mg, carbonates of Mg, Ca, Sr or Ba, diamond or carbides or nitrides of W or Si, having a mean diameter of from 1 to 50 $\mu$m. Instead of adding inorganic particles, the surface to be treated can also be structured, prior to coating, by etching, embossing or blasting, Optionally, heating is then carried out. The present invention furthermore relates to surfaces of apparatuses and apparatus parts for chemical plant construction which have been coated by the novel process, and the use of the coating, containing a metal component, at least one halogenated polymer and optionally further polymers, for reducing the tendency of the coated surfaces to accumulate solids from fluids with formation of deposits. Finally, the present invention relates to apparatuses and apparatus parts for chemical plant construction which have been coated by the novel process.

This novel achievement of the object is based on a process for the currentless chemical deposition of metal-polymer dispersion layers which is known per se (W. Riedel: Funktionelle Vernickelung, Verlag Eugen Leize, Saulgau, 1989, pages 231 to 236, ISBN 3-750480-044-x). The deposition of the metal layer or the metal-polymer dispersion phases serves for coating the conventional apparatuses and apparatus parts in chemical plant construction. The metal layer deposited according to the invention comprises an alloy or alloy-like mixed phase of a metal and at least one further element. The metal-polymer dispersion phases preferred according to the invention comprise a polymer, in particular a halogenated polymer, which is dispersed in the metal layer. The metal alloy is preferably a metal-boron alloy or a metal-phosphorus alloy having a boron or phosphorus content of from 0.5 to 15%.

A particularly preferred embodiment of the novel coatings comprises chemical nickel systems, i.e. phosphorus-containing nickel alloys having a phosphorus content of from 0.5 to 15% by weight; phosphorus-containing nickel alloys containing from 5 to 12% by weight are very particularly preferred.

The metal-polymer dispersion layer which is preferred according to the invention and is also referred to as a composite layer contains a metal component and at least one polymer, for the purposes of the present invention at least one halogenated polymer and optionally further polymers which are dispersed in the metal component.

Alloys having a phosphorus content of from 0.5 to 15% by weight are preferred; phosphorus-containing nickel alloys with from 5 to 12% by weight are very particularly preferred.

In contrast to electrochemical deposition, in chemical or autocatalytic deposition the necessary electrons are not provided by an external current source but are produced by chemical reaction in the electrolyte itself (oxidation of a reducing agent). The coating is effected by immersing the workpiece in a metal-electrolyte solution which has optionally been mixed beforehand with a stabilized polymer dispersion.

The metal-electrolyte solutions usually used are commercial or freshly prepared metal-electrolyte solutions to which, in addition to the electrolyte, the following components are also added: a reducing agent, such as a hypophosphite or boranate (for example $NaBH_4$); a buffer mixture for adjusting the pH; optionally an activator, for example an alkali metal fluoride, preferably NaF, KF or LiF; carboxylic acids and optionally a deposition moderator, such as $Pb^{2+}$. The reducing agent is chosen so that the corresponding element to be incorporated is already present in the reducing agent.

The polymer optionally to be used in the novel process has a low surface energy. The surface energy may be measured by determining the contact angle (D. K. Owens et al., J. Appl. Polym. Sci. 1969, 13, 1741). The surface energies of the polymers should be from 10 to 30 mN/m for this purpose. Halogenated polymers are preferred, particularly preferably fluorinated polymers. Examples of suitable fluorinated polymers are polytetrafluoroethylene, perfluoroalkoxy polymers (PFA), copolymers of tetrafluoroethylene and perfluoroalkoxyvinyl ethers, e.g. perfluorovinyl propyl ether. Polytetrafluoroethylene (PTFE) and perfluoroalkoxy polymers (PFA, according to DIN 7728, Part 1, January 1988) are particularly preferred.

The form used expediently comprises commercial polytetrafluoroethylene dispersions (PTFE dispersions). PTFE dispersions having a solids content of from 35 to 60% by weight and a mean particle diameter of from 0.1 to 1 atm, in particular from 0.1 to 0.3 $\mu$m, are preferably used. Spherical particles are particularly preferably used because the use of spherical particles leads to very homogeneous composite layers. The advantage of using spherical particles is a more rapid growth of the layer and better, in particular longer, thermal stability of the baths, both of which have economic advantages. This is particularly evident in comparison with systems using irregular polymer particles which are obtained by milling the corresponding polymer. In addition, the dispersions used may contain a nonionic detergent (for example polyglycols, alkylphenol ethoxylates or optionally mixtures of said substances, from 80 to 120 g of neutral detergent per liter) or an ionic detergent (for example alkyl sulfonates, haloalkyl sulfonates, alkylbenzene sulfonates, alkylphenol ether sulfates, tetraalkylammonium salts or optionally mixtures of said substances, from 15 to 60 g of ionic detergent per liter) for stabilizing the dispersion. Fluorinated surfactants (neutral and ionic) may additionally be introduced, 1–10% by weight, based on the total amount of surfactant, typically being used.

This process described in WO 00/40774 is improved according to the invention by producing the protuberances having a mean height of 100 nm to 50 $\mu$m and a mean spacing of 100 nm to 100 $\mu$m and applying the coating thereon. This can be particularly advantageously effected in situ by adding inorganic particles having a mean diameter of 1 to 50 $\mu$m to the plating bath and thus structuring the surface of the apparatuses or apparatus parts to e coated. The inorganic particles added according to the invention are known per se. They may comprise:

oxides of B, Si, Al, Ti, Zr or Cr;

mixed oxides of B, Si, Al, Ti or Cr, silicates of Al, Mg or Ca, carbonates of Ca, Sr or Ba, diamond or carbides or nitrides of W or Si or Ti.

The method by which the inorganic particles were produced is not critical per se. Thus, they may be, for example, pyrogenic metal oxides, hydrogels, aerogels, for example the Aerosil® grades from Degussa, or glasses, for example glass beads or blasting material. Inorganic structure templates of natural origin, such as diatomaceous earth or kieselguhr, are also suitable.

In a preferred embodiment the inorganic particles can be rendered hydrophobic by a suitable pretreatment, and the antiadhesion and antiwetting properties of the surfaces to be coated can be further improved. A suitable pretreatment comprises, for example, a chemical pretreatment with compositions imparting hydrophobic properties, for example with halogenated or nonhalogenated organosilanes, such as trimethylchlorosilane, dimethyldichlorosilane or phenyldimethylchlorosilane, organofluorosilanes being particularly preferred;

organofluorosilanes, such as trimethylfluorosilane, particularly preferably perfluoroalkyltrichlorosilanes, for example trifluoromethyltrichlorosilane, perfluoro-n-butyltrichlorosilane or perfluoro-n-octyltrichlorosilane;

fluorine-containing surfactants, commercially available from 3M or E. I. DuPont de Nemours, cationic surfactants being preferred;

fluorine, HF or mixtures thereof;

ion bombardment with F ions (Sputtering, for example, J. W. Mayer et al. in Ion Implantation of Semiconductors, Academic Press 1970)

The inorganic particles have a mean diameter of from 1 to 50 $\mu$m, preferably from 10 to 50 $\mu$m. The particle size distribution is narrow. A broad or a bimodal particle size distribution is not preferred. The particles may have a spherical or irregular shape.

By means of the novel process, the inorganic particles are deposited on the surface to be coated in such a way that they form protuberances of from 100 nm to 50 $\mu$m, preferably from 15 to 50 $\mu$m, and that the protuberances have a mean spacing of from 100 nm to 100 $\mu$m.

By means of the novel process, a surface having particularly low surface energy is produced in a very simple manner. The surface energies of the surfaces coated according to the invention, determined according to Owens et al. (see above), are from 10 to 25 mN/m.

From 5 to 20 g/l of inorganic particles are expediently added to the plating bath; if smaller amounts are added, formation of the desired structures is not ensured.

The structuring of the surface can also be effected by etching, embossing or blasting, for example, sandblasting, instead of by adding inorganic particles. Etching can be carried out, for example, using the known compositions for chemical etching or by physical etching, such as ion etching with oxygen or other means of bombardment, for example sandblasting. However, the addition of inorganic particles to the plating bath is preferred owing to the particularly simple handling, especially for poorly accessible apparatus parts.

Coating is carried out at slightly elevated temperature which however, may not be so high that the dispersion is destabilized. Temperatures from 40 to 95° C. have proven suitable. Temperatures of from 80 to 91° C. are preferred, particularly preferably 88° C.

It is important that the plating solution which contains the inorganic particles according to the invention is agitated during the deposition process. This can be done by stirring the immersion bath or by pumping the plating solution through the apparatus part to be coated. If the plating solution is not agitated, there is a risk of premature settling of the inorganic articles. Premature settling of the inorganic particles is undesired.

Deposition rates of from 1 to 15 $\mu$m/h have proven useful. The deposition rate can be influenced by the composition of the immersion baths as follows:

High temperatures increase the deposition rate, having a maximum temperature which is limited, for example, by the stability of the optionally added polymer dispersion. The deposition rate is reduced by reducing the temperature.

The deposition rate is increased by increasing the electrolyte concentrations and reduced by lowering them, concentrations of from 1 to 20 g/l, preferably from 40 to 10 g/l, of $Ni^{2+}$ being expedient; for $Cu^{2+}$ from 1 to 50 g/l are expedient.

The deposition rate can also be increased by increasing the concentration of reducing agent;

The deposition rate can be increased by increasing the pH. A pH of from 3 to 6 is preferably established, particularly preferably from 4 to 5.5.

The addition of activators, such as alkali metal fluorides, for example NaF or KF, increases the deposition rate.

Commercial nickel electrolyte solutions which contain $Ni^{2+}$, sodium hypophosphite, carboxylic acids and fluoride and, if required, deposition moderators, such as $Pb^{2+}$, are particularly preferably used. Said solutions are sold, for example, by Riedel, Galvano und Filtertechnik GmbH, Halle, Westfalia, and Atotech Deutschland GmbH, Berlin. Solutions which have a pH of about 5 and contain about 27 g/l of $NiSO_4.6\ H_2O$ and about 21 g/l of $NaH_2PO_2.H_2O$ at a PTFE content of from 1 to 25 g/l are particularly preferred.

The polymer content of the dispersion coating is influenced mainly by the amount of added polymer dispersion and the choice of detergents. The concentration of the polymer plays the greater role; high polymer concentrations of the immersion baths lead to a disproportionately high polymer content in the metal-phosphorus-polymer dispersion layer or metal-boron-polymer dispersion layer.

To bring them into contact, the parts to be coated are immersed in immersion baths which contain the metal-electrolyte solution. In another embodiment of the novel process, the containers to be coated are filled with metal-electrolyte solution. A further suitable process comprises pumping the electrolyte solution through the part to be coated; this variant is particularly preferable when the diameter of the part to be coated is much smaller than the length.

During the dipping operation, no catalytic decomposition reactions of the baths are observed.

The immersion process is preferably followed by heating at from 200 to 400° C., especially from 315 to 380° C. The duration of heating is in general from 5 minutes to 3 hours, preferably from 35 to 60 minutes.

It was found that the surfaces treated according to the invention permit good heat transmission although the coatings can have a not inconsiderable thickness of from 1 to 100 μm. From 3 to 50 μm are preferred, in particular from 5 to 25 μm. The polymer content of the dispersion coating is from 5 to 30, preferably from 15 to 25, % by volume. The surfaces treated according to the invention furthermore prove to be substantially more antiadhesive than those described in WO 00/40774. The surfaces treated according to the invention furthermore have excellent durability.

The present invention furthermore relates to a process for the production of modified, i.e. coated surfaces of apparatuses and apparatus parts for chemical plant construction, which are particularly strongly adhering, durable and heat-resistant and therefore achieve the object according to the invention in a particular manner.

This process comprises additionally applying a from 1 to 15 μm, preferably 1 to 5 μm, thick metal-phosphorus layer by currentless chemical deposition before the application of the metal-polymer dispersion layer.

The currentless chemical application of a from 1 to 15 μm thick metal-phosphorus layer for improving the adhesion is in turn effected by means of metal-electrolyte baths, to which however no stabilized polymer dispersion is added in this case. Heating is preferably dispensed with at this time since this generally adversely effects the adhesion of the subsequent metal-polymer dispersion layer. After deposition of the metal-phosphorus layer, the workpiece is introduced into a second immersion bath which also comprises a stabilized polymer dispersion in addition to the metal electrolyte. Here, the metal-polymer dispersion layer forms.

This process additionally comprises applying a from 1 to 15 μm, preferably a 1 to 5 μm thick metal-phosphorus layer by currentless chemical deposition before the application of the metal-polymer dispersion layer.

The currentless chemical deposition of a from 1 to 15 μm thick metal-phosphorus layer for improving the adhesion is effected by means of the metal-electrolyte baths described above, to which however no stabilized polymer dispersions are added in this case. The addition of the inorganic particles is preferably dispensed with in this step. Heating is preferably likewise dispensed with at this time since this generally adversely affects the adhesion of the subsequent metal-polymer dispersion layer. After deposition of the metal-phosphorus layer, the workpiece is introduced into the plating bath described above, which also contains a stabilized polymer dispersion in addition to the metal-electrolyte. Here, the metal-polymer dispersion layer forms.

In a preferred embodiment of the novel process, the additional metal-phosphorus layer comprises nickel-phosphorus or copper-phosphorus, nickel-phosphorus being particularly preferred.

Owing to its simple handling, the novel process can be applied to all parts of chemical reactors, reactor parts or processing machines for chemical products, which parts are threatened by deposits.

Container, apparatus and reactor walls may be present in various containers, apparatuses or reactors which are used for chemical reactions.

Containers are, for example, receivers or collecting containers such as baths, silos, tanks, barrels, drums or gas containers.

The apparatuses and reactors are liquid, gas/liquid, liquid/liquid, solid/liquid, gas/solid or gas reactors, which are realized, for example, in the following facilities:
stirred reactors, jet loop reactors and jet reactors,
jet pumps,
dwell cells,
static mixers,
stirred columns,
tubular reactors,
cylindrical stirrers,
bubble columns,
jet and venturi scrubbers,
fixed-bed reactors,
reaction columns,
evaporators,
rotary disk reactors,
extraction columns,
kneading and mixing reactors and extruders,
mills,
belt reactors,
rotating tubes or
circulating fluidized beds;

Discharge apparatuses are, for example, discharge nozzles, discharge hoppers, discharge pipes, valves, discharge forceps or ejection apparatuses.

Fittings may be, for example, forceps, valves, slides, bursting disks, nonreturn valves or disks.

Pumps may be, for example, centrifugal pumps, gear pumps, screw pumps, eccentric screw pumps, planetary pumps, reciprocating pumps, diaphragm pumps, screw trough pumps or liquid jet pumps, as well as reciprocating diaphragm pumps, rotary piston pumps, rotary vane pumps, liquid ring pumps, Roots pumps or ejector vacuum pumps.

Filters or filter apparatuses are, for example, fluid filters, fixed-bed filters, gas filters, sieves or separators.

Compressors are, for example, reciprocating compressors, diaphragm vacuum compressors, sliding vane rotary compressors, rotary multi-vane compressors, liquid ring compressors, rotary compressors, Roots compressors, screw-type compressors, jet compressors or turbo compressors.

Centrifuges are, for example, centrifuges having a sieve wall or solid wall, disk centrifuges, solid-wall helical conveyor centrifuges (decanters), screen-conveyor centrifuges and reciprocating-conveyor centrifuges being preferred.

Columns are containers having replaceable trays, bubble trays, valve trays or sieve trays being preferred. In addition, the columns may be filled with various packings, for example saddle packings, Raschig rings or spheres.

Dryers are, for example, belt dryers, shaft dryers, rotary dryers, milling dryers, spherodizers, spin-flash dryers, fluidized-bed dryers, pneumatic dryers, atomizer dryers, spray cyclones, spray fluidized beds, drum dryers, paddle dryers, tumbler dryers, steam-pipe dryers, screw-conveyor dryers, immersed-disk dryers, disk dryers, thin-film contact dryers, vertical dryers, conical screw dryers or continuators;

Heat exchangers are, for example, tube-bundle heat exchangers, U-tube heat exchangers, trickle heat exchangers, double-pipe heat exchangers, lamella heat exchangers, plate-type heat exchangers and spiral heat exchangers;

Comminuting machines are, for example, crushers, hammer crushers, impact crushers, roller crushers, or jaw crushers being preferred;

or mills, hammer mills, cage mills, pinned-disk mills, impact mills, tube mills, drum mills, ball mills, vibratory mills and roll mills being preferred.

Internals in reactors and containers are, for example, thermal sleeves, flow spoilers, foam destroyers, packings, spacers, centering means, flange joints, static mixers, instruments used for analysis such as pH or IR probes, conductivity measuring instruments, level measuring apparatuses or foam probes.

Extruder elements are, for example, screw shafts, screw elements, extruder barrels, plasticating screws or injection nozzles.

The present invention furthermore relates to apparatuses and apparatus parts for chemical plant construction which are obtainable by the novel process for surface modification.

The present invention furthermore relates to coated apparatuses and apparatus parts for chemical plant construction. The novel reactors, reactor parts and processing machines for chemical products are distinguished by a longer life, shorter down times and reduced cleaning. Those surfaces of the novel apparatuses and apparatus parts for chemical plant construction which have been coated by the novel process are furthermore distinguished by excellent mechanical stability and wear resistance.

The novel reactors can be used for a large number of different reactions, for example polymerization or synthesis of bulk or fine chemicals or pharmaceutical products and their precursors as well as cracking reactions. The processes are continuous, semicontinuous or batchwise, the novel apparatuses and apparatus parts being particularly useful for chemical plant construction in continuously operated processes.

A working example which follows illustrates the invention.

WORKING EXAMPLE

Coating of a Stirred Kettle and Stirring Element for Dispersion Polymerization 1. Rendering the Inorganic Particles Hydrophobic 40 g of glass beads having a mean particle diameter of 40 μm (blasting material from Eisenwerke Wurth GmbH) were treated with 100 ml of perfluoro-n-octyltrichlorosilane (5% strength by weight solution in heptane) in a round-bottomed flask for 3 hours at 95° C. The supernatant solution was then filtered off.

2. Coating

A 2 liter stirred kettle (which material?) was filled with 1.9 liters of an aqueous nickel salt solution, the solution having the following composition: 27 g/l of $NiSO_4.6\ H_2O$, 21 g/l of $NaH_2PO_2.2H_2O$, 20 g/l of lactic acid $CH_3CHOHCO_2H$, 3 g/l of propionic acid $C_2H_5CO_2H$, 5 g/l of sodium citrate, 1 g/l of NaF (commercially available from Riedel) and 20 ml of a commercial PTFE dispersion from Dyneon (i.e. about 1% by volume), having a density of 1.5 g/ml. The PTFE dispersion contained 50% by weight of solids having a mean particle diameter of 40 μm. Furthermore, 22 g of the inorganic particles obtained under 1. were added. The pH was 4.8. Careful stirring was carried out for 120 minutes at 88° C. in order to obtain the desired layer thickness of 20 μm.

3. Testing and Comparative Example 2 test series were carried out.

In each case 7 analogous polymerization experiments were carried out in a 2 liter stirred kettle which was coated according to the invention and in a 2 liter stirred kettle which was otherwise identical but not coated, without intermediate opening of the kettle. Polymer dispersions were prepared by the emulsion polymerization method with the main monomers n-butyl acrylate and styrene, sodium peroxodisulfate serving as initiator. The polymerization process is described in D. Distler, WäBrige Polymerdispersionen, pages 11–13, Weinheim: Wiley-VCH, 1999 (Laboratory Example 2).

Subsequently the kettle was opened and the deposits on the kettle and stirring element were qualitatively evaluated. The quantitative evaluation was carried out by weighing the lower part of the kettle and the stirring element.

| | | |
|---|---|---|
| Weight: | Uncoated stirrer | 467.52 g |
| | Uncoated kettle | 18326.71 g |
| | Coated stirrer | 468.43 g |
| | Coated kettle | 18333.49 g |

| | Stirrer | Kettle |
|---|---|---|
| 1. Without coating | 3.18 | 15.26 |
| 2. With coating | 0.93 | 4.87 |

It was also observed that, especially at the liquid/gas interface, the use of the coating resulted in a greater reduction of deposits than in the purely wet part, both on the stirrer shaft and on the kettle rim.

What is claimed is:

1. A process for coating apparatuses and apparatus parts for chemical plant construction, the surface to be coated is structured so that it has protuberances having a mean height of from 100 nm to 50 $\mu$m with a mean spacing of from 100 nm to 100 $\mu$m on the surface to be coated and the coating is applied thereon by currentless deposition of a metal-polymer dispersion layer with the aid of a plating bath which contains a metal electrolyte, a reducing agent and a polymer or polymer blend to be deposited, in dispersed form.

2. A process as claimed in claim 1, wherein the apparatuses and apparatus parts are apparatus, container and reactor inner surfaces, discharge apparatuses, fittings, pipe systems, pumps, filters, compressors, centrifuges, columns, heat exchangers, dryers, comminuting machines, internals, packings and mixing elements, which comprise a metallic material.

3. A process as claimed in claim 1, wherein said protruberances are produced by adding to the plating bath inorganic particles selected from oxides or mixed oxides of B, Si, Al, Ti, Zr, Cr, silicates of Al, Ca or Mg, carbonates of Mg, Ca, Sr or Ba, diamond or carbides or nitrides of W or Si or Ti, having a mean diameter of from 1 to 50 $\mu$m.

4. A process as claimed in claim 3, wherein said particles are rendered hydrophobic in a separate step before addition to the plating bath.

5. A process as claimed in claim 4, wherein the inorganic particles for imparting hydrophobic properties are treated with silanes, fluorosilanes, halogenated or nonhalogenated organosilanes, fluorine surfactants, fluorine or HF.

6. A process as claimed in claim 4, wherein the inorganic particles for imparting hydrophobic properties are bombarded with F ions.

7. A process as claimed in claim 1, wherein said protuberances are produced by etching, embossing or blasting.

8. A process as claimed in claim 1, wherein the metal electrolyte used is a nickel or copper electrolyte solution and the reducing agent used is a hypophosphite or a boranate.

9. A process as claimed in claim 1, wherein a dispersion of a halogenated polymer is added to the metal electrolyte solution.

10. A process as claimed in claim 1, wherein the metal electrolyte used is a nickel salt solution which is reduced in situ with an added alkali metal hypophosphite and to which a polytetrafluoroethylene dispersion is added as halogenated polymer.

11. A process as claimed in claim 1, wherein a halogenated polymer comprising particles having a mean diameter of from 0.1 to 1.0 $\mu$m is used as the polymer to be deposited.

12. A process as claimed in claim 1, wherein a halogenated polymer comprising spherical particles having a mean diameter of from 0.1 to 1.0 $\mu$m is used as the polymer to be deposited.

13. A process as claimed in claim 1, wherein a nickel-phosphorus-polytetrafluoroethylene layer having a thickness of from 1 to 100 $\mu$m is deposited.

14. A process as claimed in claim 1, wherein a nickel-phosphorus-polytetrafluoroethylene layer having a thickness of from 5 to 25 $\mu$m is deposited.

15. An apparatus or apparatus part for chemical plant construction obtained by the process of claim 1.

16. An apparatus, container or reactor wall, discharge apparatus, fitting, pipe system, pump, filter, compressor, centrifuge, column, dryer, comminuting machine, internal, packing or mixing element, obtained by the process of claim 1.

* * * * *